US008790162B1

(12) United States Patent
Dovel

(10) Patent No.: US 8,790,162 B1
(45) Date of Patent: Jul. 29, 2014

(54) SHARPENING A CUTTING EDGE OF A TOOL USING A REVERSE SHARPENING GUIDE

(71) Applicant: Darex, LLC, Ashland, OR (US)

(72) Inventor: Daniel T. Dovel, Shady Cove, OR (US)

(73) Assignee: Darex LLC, Ashland, OR (US)

( * ) Notice: Subject to any disclaimer, the term of this patent is extended or adjusted under 35 U.S.C. 154(b) by 0 days.

(21) Appl. No.: 14/026,848

(22) Filed: Sep. 13, 2013

(51) Int. Cl.
*B24B 3/54* (2006.01)
*B24B 3/36* (2006.01)

(52) U.S. Cl.
CPC .... *B24B 3/36* (2013.01); *B24B 3/54* (2013.01)
USPC ..... 451/45; 76/88; 451/57; 451/59; 451/321; 451/322; 451/555

(58) Field of Classification Search
CPC .. B24D 15/063; B24D 15/065; B24D 15/088; B24B 3/54; B24B 3/52; B24B 41/066; B24B 15/08
USPC ..... 76/82, 82.2, 88, 89; 451/45, 241, 267, 451/282, 293, 312, 313, 321, 322, 438, 545, 451/558, 57, 59, 555
See application file for complete search history.

(56) References Cited

U.S. PATENT DOCUMENTS

| | | | | | |
|---|---|---|---|---|---|
| 21,058 | A | * | 8/1858 | Armstrong | 76/88 |
| 78,771 | A | | 6/1868 | Thayer | |
| 606,000 | A | * | 6/1898 | Clark | 76/88 |
| 1,158,048 | A | | 10/1915 | Hawks | |
| 1,271,953 | A | * | 7/1918 | Sebring | 76/88 |
| 1,326,101 | A | | 12/1919 | Schmidt | |
| 1,619,581 | A | * | 3/1927 | McLean | 76/82.2 |
| 1,629,980 | A | * | 5/1927 | Tietz | 451/461 |
| 1,852,223 | A | * | 4/1932 | Stockert | 76/81 |
| 1,888,102 | A | | 11/1932 | Zahler | |
| 2,098,530 | A | * | 11/1937 | Battocchi | 451/555 |
| 2,160,979 | A | * | 6/1939 | Moeller | 451/555 |
| 2,403,380 | A | * | 7/1946 | Kuzdal | 76/81.5 |
| 2,652,667 | A | | 9/1953 | Arnold | |
| 3,654,823 | A | | 4/1972 | Juranitch | |
| 3,882,642 | A | | 5/1975 | Sykes | |
| 4,094,106 | A | | 6/1978 | Harris | |
| 4,197,677 | A | * | 4/1980 | Graves | 451/555 |
| 4,450,653 | A | * | 5/1984 | Fletcher | 451/552 |
| 4,558,540 | A | * | 12/1985 | Collins | 451/555 |
| D287,095 | S | | 12/1986 | Hunter | |
| 4,850,149 | A | * | 7/1989 | Phillips | 451/241 |
| 4,991,357 | A | * | 2/1991 | Stickles, Sr. | 451/555 |

(Continued)

*Primary Examiner* — Timothy V Eley
(74) *Attorney, Agent, or Firm* — Hall Estill Attorneys at Law

(57) ABSTRACT

Apparatus and associated method for sharpening a cutting edge of a tool. In accordance with some embodiments, a side of the tool is placed in contacting engagement against a reverse sharpening guide surface to orient the tool at an acute angle with respect to an abrasive surface, with the abrasive surface extending in a lateral direction from a first end to a second end and the reverse sharpening guide surface located proximate the first end. The tool is moved away from the reverse sharpening guide surface and along the abrasive surface in the lateral direction toward the second end while nominally maintaining the tool at the acute angle so that a cutting edge of the tool is sharpened against the abrasive surface in a trailing cutting edge orientation with a top surface of the tool opposite the cutting edge maintained closer to the second end than the cutting edge.

19 Claims, 9 Drawing Sheets

(56) References Cited

U.S. PATENT DOCUMENTS

| | | | | |
|---|---|---|---|---|
| 5,458,534 | A | 10/1995 | Campione et al. | |
| 6,048,262 | A | 4/2000 | Ray | |
| D444,691 | S | 7/2001 | Ray | |
| 6,371,841 | B1 | 4/2002 | Ray | |
| 6,547,656 | B1 | 4/2003 | LeVine | |
| 6,997,795 | B2 | 2/2006 | Friel, Sr. | |
| 7,182,678 | B2 * | 2/2007 | Keska | 451/367 |
| D560,461 | S | 1/2008 | Epstein | |
| 7,467,991 | B2 | 12/2008 | McCowen et al. | |
| D604,134 | S | 11/2009 | Smith et al. | |
| 2008/0020681 | A1 * | 1/2008 | Leyva | 451/45 |

* cited by examiner

OBTUSE ANGLE SHARPENING

SHARPENING A CUTTING EDGE OF A TOOL USING A REVERSE SHARPENING GUIDE

BACKGROUND

Cutting tools such as knives are used in a variety of applications to cut or otherwise remove material from a workpiece. A cutting tool often has one or more laterally extending, straight or curvilinear cutting edges along which pressure is applied to make a cut. The cutting edge is often defined along the intersection of opposing surfaces that intersect along a line that lies along the cutting edge.

Cutting tools can become dull over time after extended use, and thus it can be desirable to subject a dulled cutting tool to a sharpening operation to restore the cutting edge to a greater level of sharpness. A variety of sharpening systems are known in the art, including but not limited to grinding wheels, whet stones, abrasive cloths, abrasive belts and sharpening steels.

SUMMARY

Various embodiments of the present disclosure are generally directed to an apparatus and associated method for sharpening a cutting tool, such as but not limited to a kitchen knife.

In accordance with some embodiments, a side of the tool is placed in contacting engagement against a reverse sharpening guide surface to orient the tool at an acute angle with respect to an abrasive surface, with the abrasive surface extending in a lateral direction from a first end to a second end and the reverse sharpening guide surface located proximate the first end. The tool is moved away from the reverse sharpening guide surface and along the abrasive surface in the lateral direction toward the second end while nominally maintaining the tool at the acute angle so that a cutting edge of the tool is sharpened against the abrasive surface in a trailing cutting edge orientation with a top surface of the tool opposite the cutting edge maintained closer to the second end than the cutting edge.

These and other features and advantages of various embodiments can be understood with a review of the following detailed description and the accompanying drawings.

DETAILED DESCRIPTION

The present disclosure is generally directed to an apparatus and method for sharpening a cutting tool. As explained below, a reverse sharpening guide arrangement is used to orient a tool prior to advancement of the tool along an abrasive surface to sharpen a cutting edge of the tool. The reverse sharpening guide is configured such that the tool is "pulled" across the abrasive surface, rather than "pushed" across the abrasive surface as is commonly employed in existing designs. During sharpening in accordance with the present disclosure, the tool is oriented so that a top surface of the tool opposite the cutting edge precedes the cutting edge with respect to the abrasive surface.

The reverse sharpening guide may be disposed below an elevation of the abrasive surface so that the tool is moved upwardly in sliding engagement along a guide surface of the reverse sharpening guide prior to engagement with the abrasive surface. Alternatively, the reverse sharpening guide may be disposed above an elevation of the abrasive surface so that the tool is placed against the guide surface and then laterally advanced away from the guide surface and across the abrasive surface.

In both cases, the abrasive surface is generally subjected to a tension force proximate the cutting edge, rather than a compressive force, and the tool is oriented in a trailing cutting edge orientation so that the cutting edge is pointing away from the direction of movement. This reduces a likelihood that the cutting edge will cut or otherwise damage the abrasive surface. While the abrasive surface may be locally deformable, enhanced sharpening efficiencies may be achieved even with the use of rigid abrasive members since material removed from the tool in the vicinity of the cutting edge is drawn away from, rather than pushed into, the tool.

Figure 1:
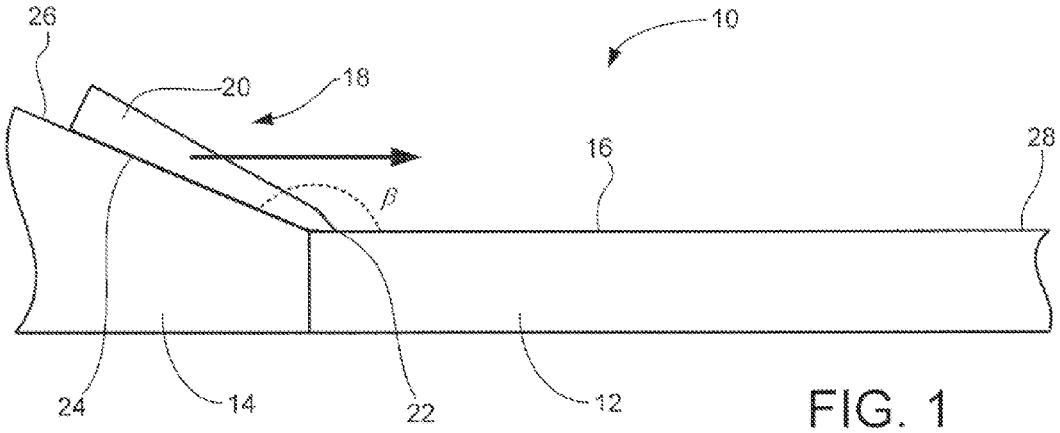
FIG. 1 Related Art
FIG. 1 shows a schematic representation of a sharpening system in accordance with the related art.

These and other features of various embodiments can be understood beginning with a review of FIG. 1 which is a schematic depiction of a sharpening system 10 in accordance with the related art. The sharpening system 10 includes a sharpening member 12 and a guide member 14. The sharpening member 12 is a rigid or semi-rigid block of material and may be formed from one or more components. The sharpening member 12 includes an abrasive surface 16 arranged along a top of the block of material.

The guide member 14 is configured to enable a user to orient a cutting tool 18 prior to a sharpening operation. The cutting tool may take the form of a knife or similar tool, and includes an elongated blade portion 20 that terminates in a cutting edge 22. To orient the cutting tool 18, the user places a side surface 24 of the blade portion 20 in contacting engagement with an angled guide surface 26 of the guide member 14. The guide surface 26 presents the tool 18 at an obtuse angle β with respect to the abrasive surface 16, as shown in FIG. 1. As used herein, an obtuse angle will be understood as an angle of greater than 90° and less than 180°.

Once the tool 18 has been placed against the guide surface 26, the user advances the tool 18 away from the guide surface 26 and along the abrasive surface 16 while nominally maintaining the tool 18 at the desired sharpening angle established by the guide surface 26. The user may apply moderate pressure to the tool 18 during the sharpening process to enable grit in the abrasive surface to remove and/or align material of the blade portion 20 to sharpen the cutting edge 22.

While operable to improve the alignment of the cutting edge 22 and hence, to sharpen the tool 18, the guide surface 26 places the tool in a leading cutting edge orientation so that the cutting edge 22 is pointing in the direction of movement and is the closest part of the tool to a distal end 28 of the abrasive surface 16.

Figure 2A:
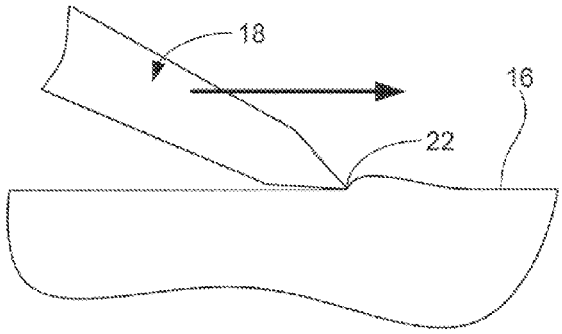
FIG. 2A Related Art
FIGS. 2A and 2B show the sharpening system of FIG. 1 in greater detail.
Figure 2B:
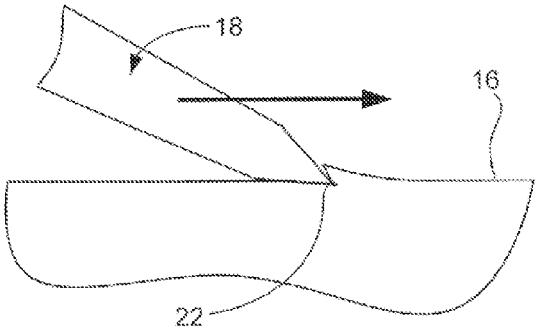
FIG. 2B Related Art

This leading cutting edge orientation generally tends to place the abrasive surface 16 into compression as the cutting edge 22 is pushed into the abrasive surface. Relatively flexible abrasive media such as leather, cloth, sandpaper and other paper-backed media, etc. may be damaged and/or cut by the cutting edge 22, as represented in FIGS. 2A-2B. Even in the case of rigid media, the pushing of the cutting edge 22 into the grit of the abrasive member 14 may tend to urge material that is removed or deformed from the blade portion (e.g., burrs) into the cutting edge, which may lengthen the sharpening process and reduce the overall effectiveness of the sharpening process.

Figure 3A:
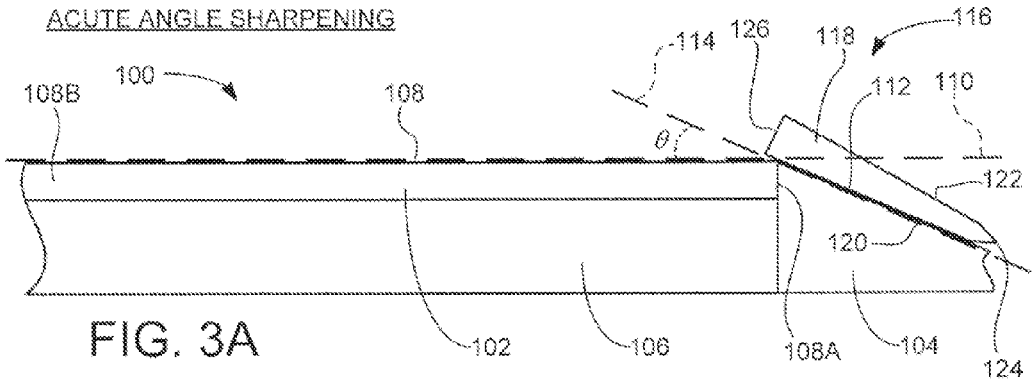
FIGS. 3A-3C show schematic representations of a sharpening system that uses a reverse sharpening guide in accordance with some embodiments of the present disclosure.
Figure 3B:
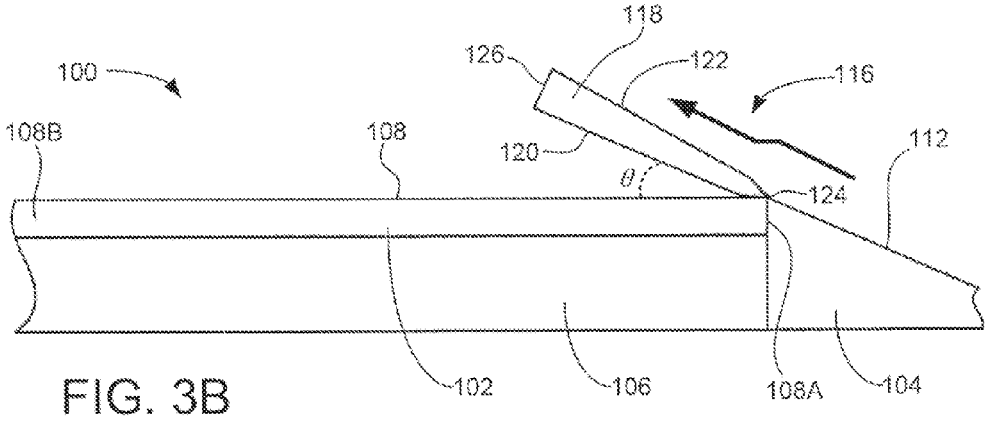
Figure 3C:
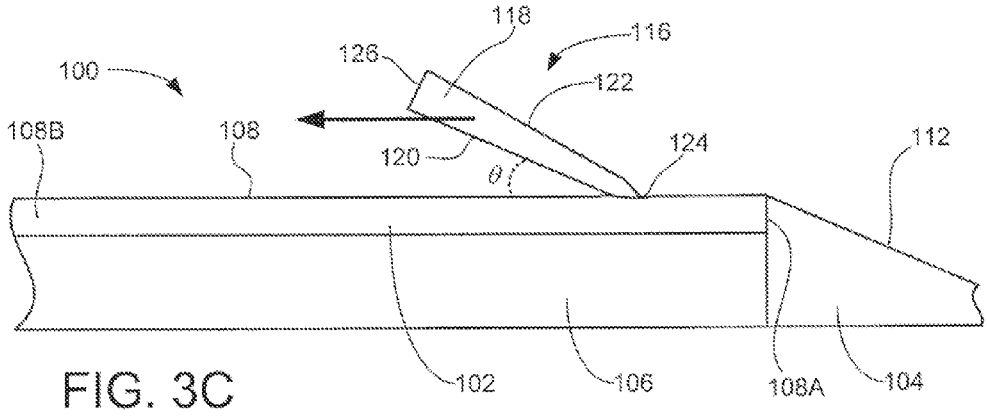
Figure 4A:
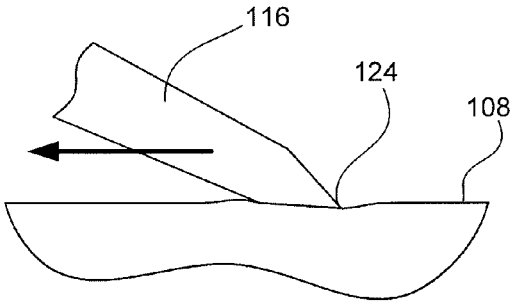
FIGS. 4A-4B show the sharpening system of FIGS. 3A-3C in greater detail.
Figure 4B:
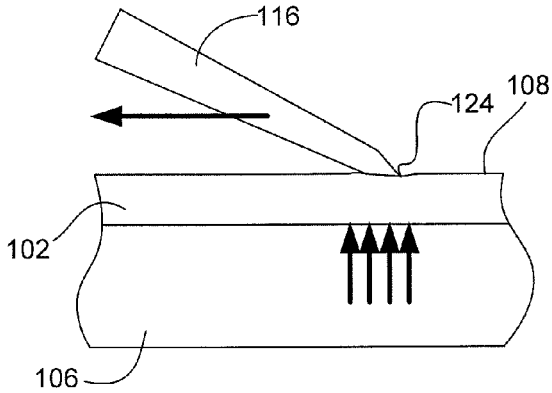

FIGS. 3A-3C schematically depict a sharpening system 100 configured to overcome these and other limitations of the related art. The sharpening system 100 includes a sharpening member 102 and a reverse sharpening guide 104. The sharpening member 102 comprises a rigid or semi-rigid block of material formed from one or more components, and is supported by an underlying base support member 106.

The sharpening member 102 includes an abrasive surface 108 arranged along a top of the block of material. Without limitation, in some embodiments the sharpening member 102 may comprise a rigid metal, plastic or glass substrate, a compressible or semi-compressible foam block, a paper substrate, an elastomeric layer of material, etc. The abrasive surface 108 may be a coating of abrasive of selected grit affixed to or supported by the underlying block, a layer of sandpaper or other abrasive media supported by the underlying block, etc.

The abrasive surface 108 in FIG. 3A has opposing first and second ends 108A and 108B, and is generally aligned along a first plane denoted by horizontal broken line 110. The reverse sharpening guide 104 is disposed adjacent the first end 108A and includes a guide surface 112 which is generally aligned along a second plane 114. The second plane 114 intersects the first plane 110 at an acute angle θ (i.e., θ<90°).

It will be noted that the guide surface 112 is generally disposed below the elevational location of the abrasive surface 108; that is, guide surface 112 is located below the first plane 110. For clarity, such arrangements are referred to herein as "lower reverse sharpening guides."

FIG. 3A further shows a cutting tool 116. The cutting tool 116 is characterized as a kitchen knife, although other forms of cutting tools can be sharpened by the system 100. The cutting tool 116 includes a blade portion 118 with opposing side surfaces 120, 122, a cutting edge 124 and a top edge 126 opposite the cutting edge 124.

The lower reverse sharpening guide 104 is arranged to allow a user to orient the cutting tool 116 in a desired angular orientation prior to a sharpening operation thereon. To align the tool 116, a selected side surface, in this case side surface 120, is brought into contacting abutment against the guide surface 112 as shown.

Once the tool 116 has been aligned, the tool is slidingly advanced upwardly along the guide surface 112 while maintaining the tool in the established angular orientation set by the guide surface 112. Once the tool 116 is advanced up onto the abrasive surface 108, as depicted in FIG. 3B, the tool 116 is moved laterally along the abrasive surface 108 in a direction toward the second end 108B, as depicted in FIG. 3C. This causes the tool 116 to be advanced in a direction away from the guide surface 112 along the lateral length of the abrasive surface 108.

The user moves the tool in this manner while applying moderate force to the tool to maintain contact between the cutting edge 124 and the abrasive surface 108 and to nominally maintain the tool 116 at the acute angle established by the guide surface 112. This places the cutting edge 124 in a trailing cutting edge orientation so that the cutting edge 124 is pointing away from the direction of movement as the tool 116 is pulled across the abrasive surface 108. Stated another way, the lateral distance from the top surface 126 of the blade portion 118 to the second end 108B of the abrasive surface is consistently smaller than the lateral distance from the cutting edge 124 to the second end 108B (e.g., the top surface 126 is maintained closer than the cutting edge 124 to the distal end 108B as the tool 116 is advanced toward the distal end).

Figure 5:
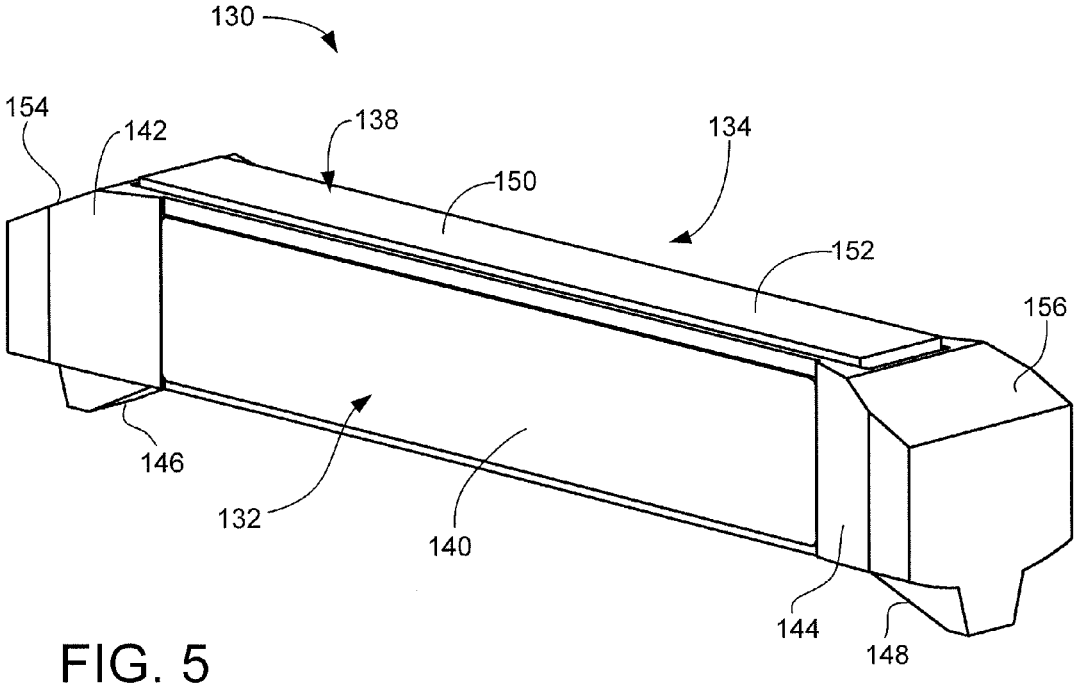
FIG. 5 is an isometric depiction of another sharpening system in accordance with some embodiments.

FIG. 5 is an isometric representation of another sharpening system 130 constructed in accordance with some embodiments. The sharpening system 130 is characterized as a hand held tool (e.g., knife) sharpener and incorporates a plurality of different sharpening stages with different abrasive grit levels to accommodate a number of different sharpening operations. In some cases, a multi-stage sharpening operation can be carried out by using an aggressive abrasive to remove relatively larger amounts of material via a first stage, followed by a finer sharpening operation to remove a smaller amount of material via a second stage. The various stages can use the same, or different, tool presentation angles.

The sharpener 130 as oriented in FIG. 5 provides a total of four (4) sharpening stages having progressively lower levels of abrasive aggressiveness: a first stage 132 on the front facing side of the sharpener 130 provides shaping (e.g., repairing a broken portion of a knife, etc.); a second stage 134 on the back facing side of the sharpener 130 provides moderate sharpening; a third stage 136 on the bottom side of the sharpener 130 provides fine sharpening (honing); and a fourth stage 138 on the top side of the sharpener 130 provides stroping (e.g., extremely fine polishing with minimal or no material removal).

While not all of the above stages are fully visible in FIG. 5, it will be understood that each of the stages 132, 134, 136 and 138 include a laterally extending abrasive surface and a pair of opposing sharpening guides at respective ends thereof. The sharpening guides for the first, second and third stages 132, 134 and 136 generally conform to the standard guides discussed above in FIGS. 1-2B and impart obtuse angles to the tool. The sharpening guides for the fourth stage 138 generally conform to the lower reverse sharpening guide structure of FIGS. 3A-3C and impart acute angles to the tool.

For reference, aspects of the first stage 132 visible in FIG. 5 include abrasive surface 140 and opposing standard guides 142, 144. The second stage 134 (back side) is largely hidden. Portions of opposing standard guides 146, 148 are visible for the third stage 136. The fourth stage 138 can be seen to include abrasive member 150 with associated abrasive surface 152 extending along the top surface thereof, and a pair of opposing lower reverse sharpening guides 154, 156.

Figure 6:
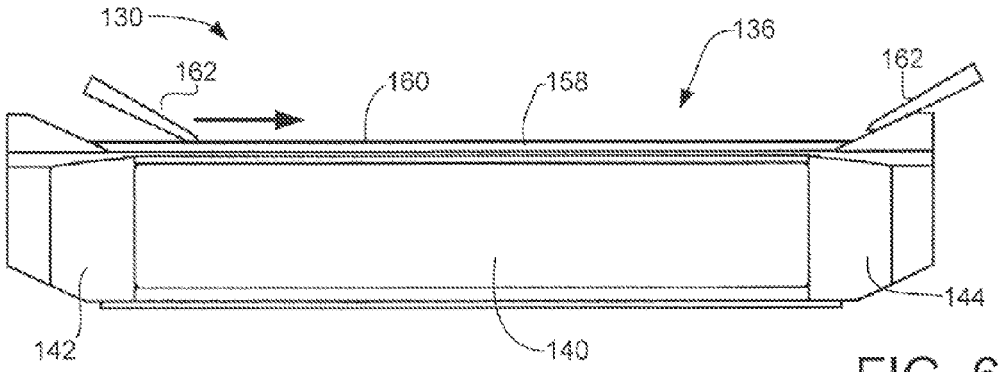
FIG. 6 illustrates use of a first side of the sharpening system of FIG. 5 to sharpen a tool.

FIG. 6 is a side elevational depiction of the sharpener 130 of FIG. 5, with the sharpener 130 inverted in FIG. 6 with respect to the orientation of FIG. 5. FIG. 6 generally illustrates the fine sharpening (honing) operation carried out on the third stage 136. A sharpening member 158 with an upper abrasive surface 160 is used to sharpen a tool (e.g., knife) 162 as discussed above in FIG. 1. Opposing sides of the tool 162 can be used by alternating use of the respective sharpening guides 146, 148.

Figure 7:
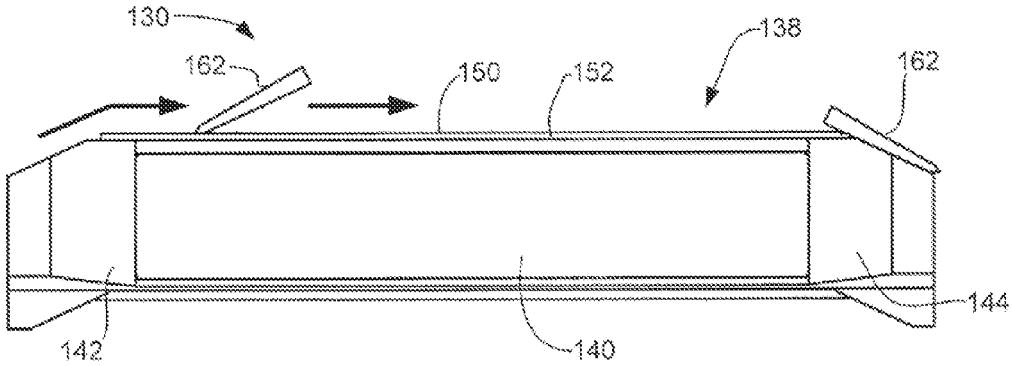
FIG. 7 illustrates use of a second side of the sharpening system of FIG. 5 to sharpen a tool.

FIG. 7 is another side elevational depiction of the sharpener 130 of FIG. 5. In FIG. 7, the sharpener 130 has the same orientation as in FIG. 5. Sharpening (in this case, stroping) of opposing sides of the tool can be carried out via the fourth stage 138 using the respective lower reverse sharpening guides 154, 156 as shown.

While not necessarily limiting, it is contemplated that the fourth stage 138 uses a leather strop as the abrasive member 150. This allows the fourth stage to provide a final stropping of the tool in a trailing cutting edge orientation following one or more sharpening operations from the prior stages using a leading cutting edge orientation for the tool. It will be appreciated, however, that any or all of the other stages could alternatively be configured to also provide the respective sharpening operations with a reverse sharpening guide and a trailing cutting edge orientation for the tool as discussed above.

Figure 8:
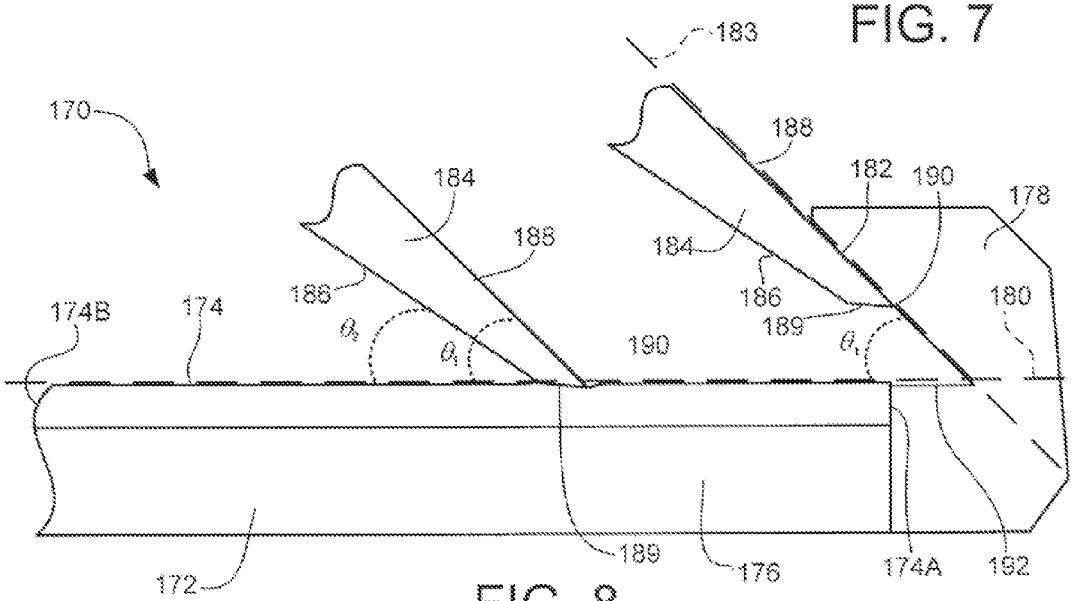
FIG. 8 schematically depicts another sharpening system with a reverse sharpening guide in accordance with some embodiments.

FIG. 8 is a schematic depiction of another sharpening system 170 in accordance with some embodiments. The sharpening system 170 includes a sharpening member 172 with an abrasive surface 174, an underlying base support member 176 which supports the sharpening member 172, and a reverse sharpening guide 178. These respective elements can take similar constructions to those discussed above for the system 100 of FIGS. 3A-3C, or can take other constructions as desired.

As before, the abrasive surface 174 has opposing proximal and distal ends 174A, 174B along a lengthwise (lateral) direction, and the abrasive surface 174 is aligned in this lateral direction along a first plane denoted by dotted line 180. The reverse sharpening guide 178 includes a guide surface 182 that is aligned along a second plane (dotted line 183) that intersects the first plane at an acute angle $\theta_1$. In this case, the guide surface 182 is substantially located above the elevational location of the abrasive surface 174, so that sharpening guides having a configuration such as at 178 are referred to herein as an "upper reverse sharpening guides."

A cutting tool 184 includes opposing side surfaces 186, 188, a front surface 189 and a cutting edge 190. The cutting edge 190 can be sharpened against the abrasive surface 174 by placing the side surface 188 in contacting engagement with the guide surface 182 to set a desired acute angle of the tool 184 relative to the abrasive surface 174. The user thereafter laterally advances the cutting tool 184 away from the guide surface 182 while maintaining the tool nominally at the acute angle established by the guide surface 182. This presents the tool 184 in a trailing cutting edge configuration as discussed above.

At this point it will be noted from FIG. 8 that the tool side surface 188 that contacts the guide surface 182 is the tool side surface that is farthest from the distal end 174B of the abrasive surface 174. This is in contrast to the lower reverse sharpening guide configuration of FIGS. 3A-3C, where the side surface of the tool 116 closest to the distal end 108A of the abrasive surface 108, namely side surface 120, is brought into contacting abutment against the guide surface 112 shown therein.

It follows that the acute angle $\theta_1$ between the first and second planes 180, 183 in FIG. 8 also corresponds to the angle between the side surface 188 and the abrasive surface 174. A slightly smaller acute angle $\theta_2$ is provided between the forward facing tool side surface 186 and the abrasive surface 174. Nevertheless, in many cases the desired control angle for sharpening tools such as 184 is the angle between the bottom surface 188 and the front surface 189 (e.g., angle $\theta_1$). Thus, as used herein the acute angle established by a given reverse sharpening guide surface with respect to the associated abrasive surface is measured from the medium to the side of the tool that contacted the guide surface in the direction of movement during the sharpening process.

Continuing with FIG. 8, in some cases a non-abrasive support surface 192 can be provisioned at the base of the guide surface 182. The support surface 192 can provide a limit stop for the tool 184 and ensure a desired plunge depth prior to advancement of the tool along the abrasive surface 174. The support surface 192 can be below, above, or even with the elevational location of the abrasive surface 174. In other cases, the abrasive surface 174 can extend to the base of the guide surface 182 so that the cutting edge 188 contactingly engages the abrasive surface while in contact with the guide surface 182.

The tool 184 depicted in FIG. 8 is a single sided tool, such as a chisel, a single side of a pair of scissors, a plane iron, etc. The upper reverse sharpening guide 178 can be adapted to sharpen other types of tools, including double sided tools such as the exemplary knife discussed above, provided an appropriate acute angle between the guide surface 182 and the abrasive surface 174 is selected.

As before, the abrasive member can be rigid, semi-rigid, compressible, etc. In some cases, high density "shoe leather" can be used with micron sized loose diamond grit to provide frequent touch-up honing for hard use blades such as plane irons, etc.

Figure 9A:
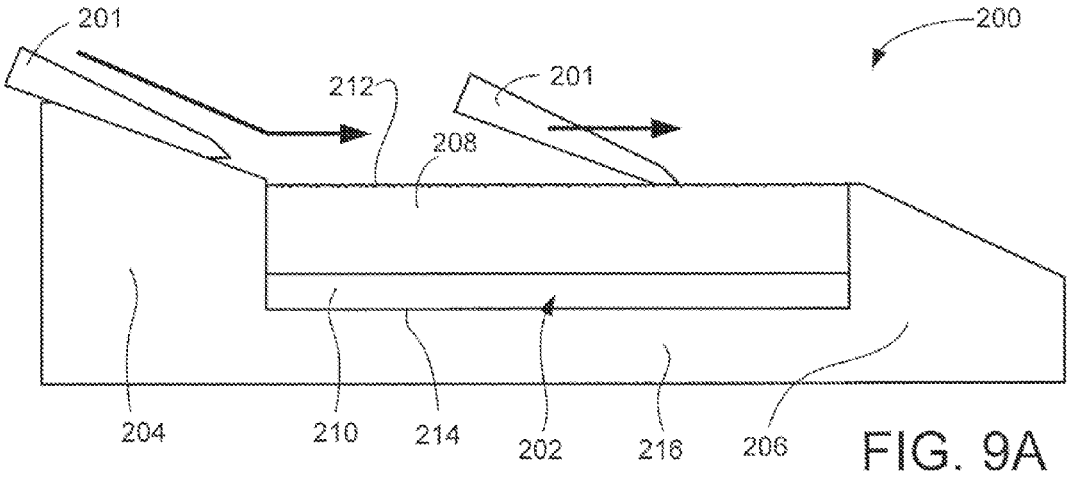
FIGS. 9A-9B schematically depict another sharpening system in accordance with some embodiments.
Figure 9B:
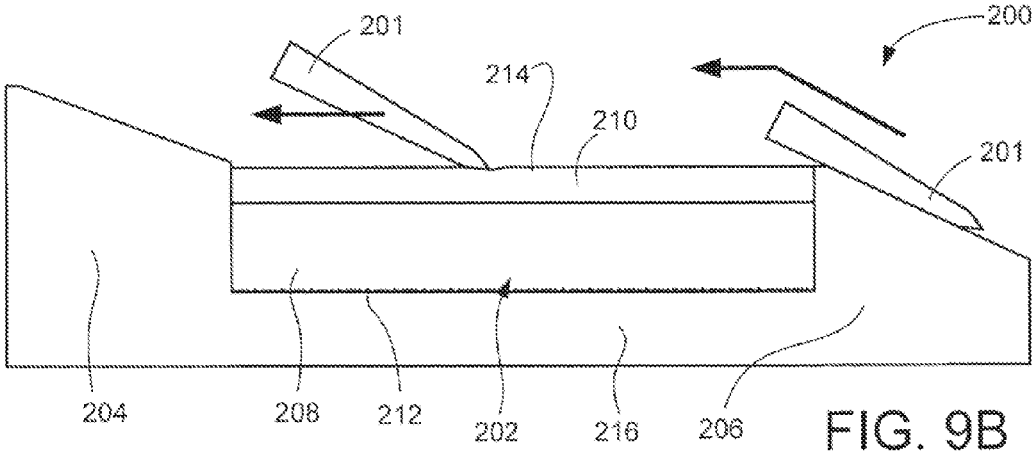

FIGS. 9A-9B illustrate another sharpening system 200 in accordance with some embodiments. The sharpening system 200 sharpens a tool 201 using a removably reversible sharpening member 202 and opposing first and second sharpening guides 204, 206. The first sharpening guide 204 is characterized as a standard sharpening guide as in FIG. 6, and the second sharpening guide 206 is characterized as a lower reverse sharpening guide as in FIG. 7.

The sharpening member 202 can be a laminate formed from a first block 208 affixed to a second block 210. The first block 208 has a first abrasive surface 212, used as depicted in FIG. 9A, and the second block 210 has a second abrasive surface 214, used as depicted in FIG. 9B. This provides respective first and second sharpening stages which can be effected by removing the sharpening member 202 from a base support structure 216, orienting the member 202 so that the desired abrasive surface 212, 214 is facing upwardly, and reinstalling the member 202 back into the base support structure 216. In some cases, the first block 208 may be a rigid member, such as a sharpening stone, etc., and the second block 210 may be a flexible member, such as a layer of leather, foam, sandpaper, etc. that can be locally deformed in response to the downwardly directed pressure applied by the user to the tool.

Figure 10:
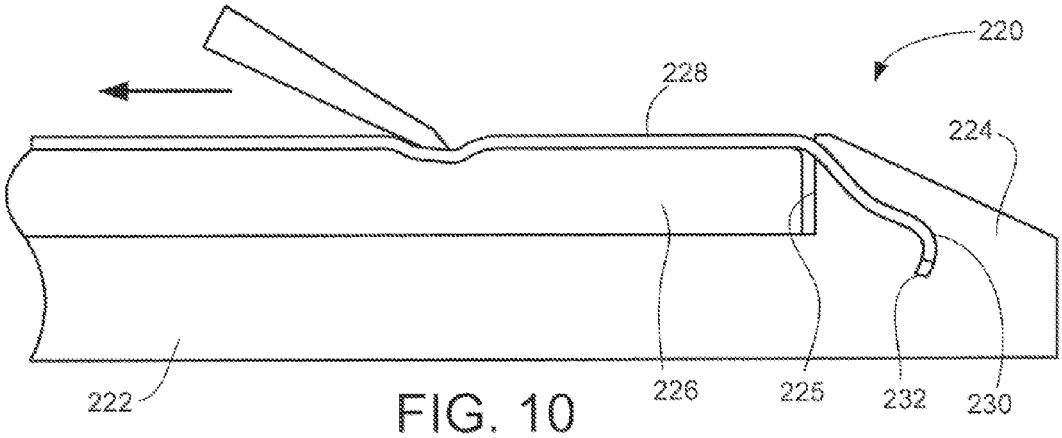
FIG. 10 schematically depicts another sharpening system in accordance with some embodiments.

FIG. 10 illustrates another sharpening system 220 in accordance with some embodiments. The sharpening system 220 sharpens a tool 221 using a base support structure 222 with an integrated lower reverse sharpening guide 224. The base support structure 222 includes a recess 225 to nestingly receive a support block 226, which may take the form of a compressible foam member. Alternatively, the support block 226 may be a rigid member such as a glass block with a flat upper surface.

A planar abrasive medium 228, such as sandpaper, is affixed to the base support structure 222, such as by inserting a proximal end 230 of the medium 228 into a corresponding securement slot 232. In this way, different grits of abrasive can be used to provide multi-stage sharpening, and worn media can be readily replaced. As desired, different foam densities can be used for the support block 226 when sharpening with different grits to alter the radius of deflection of the medium 228. A shape, sharpen, hone and strop progression can be provided by using successively less aggressive abrasive and more compressive support block combinations.

Figure 11:
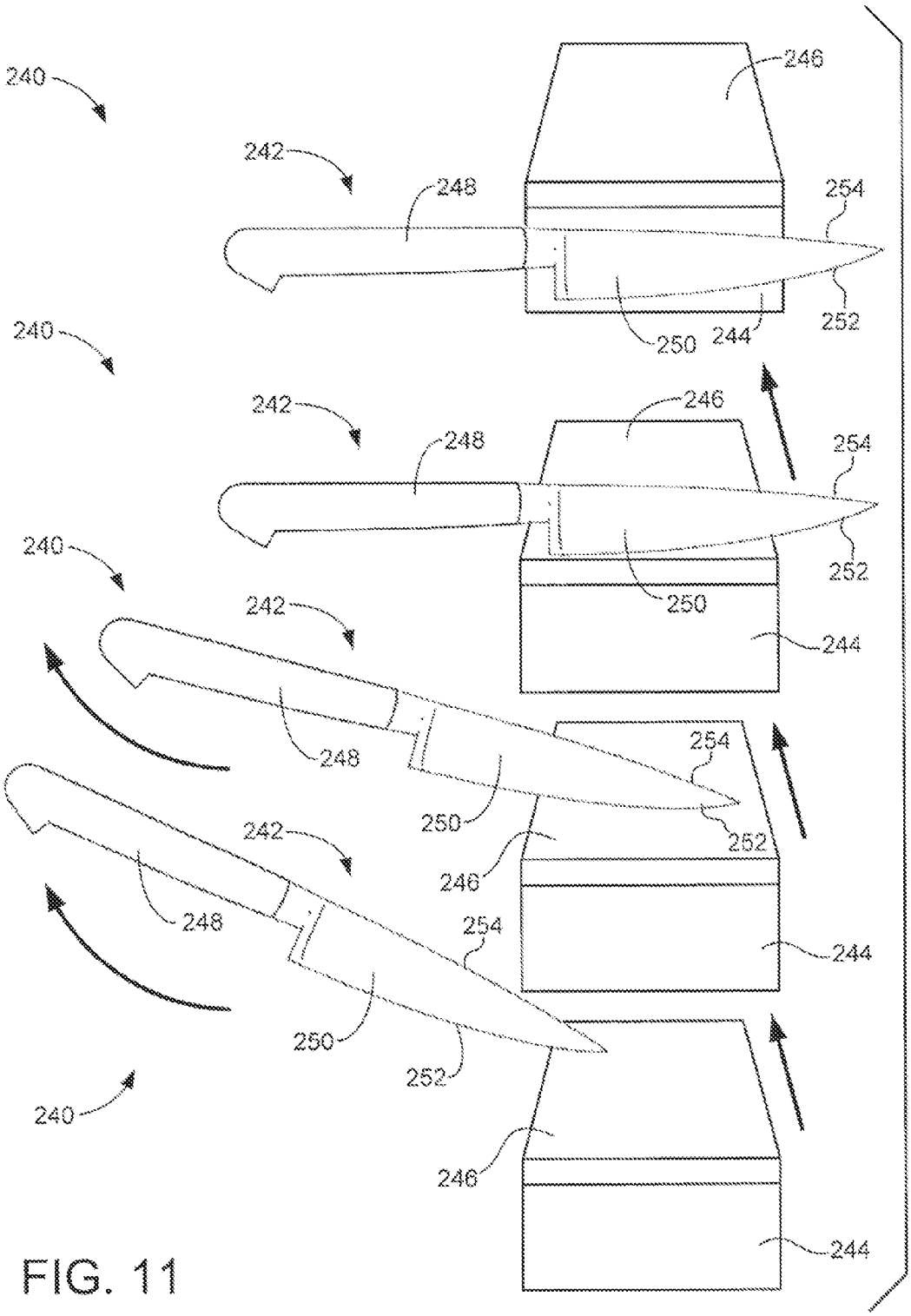
FIG. 11 provides a sharpening sequence for a kitchen knife using a reverse sharpening guide in accordance with some embodiments.

FIG. 11 illustrates a sharpening sequence that may be carried out in accordance with some embodiments using a sharpening system 240. An elevated, end perspective view of the sharpening system 240 is provided so that a cutting tool 242, characterized as a kitchen knife, is maintained in a substantially vertical orientation with respect to the viewer.

The sharpening system 240 includes a lower reverse sharpening guide surface 244 and a planar abrasive surface 246. The knife 242 includes a handle 248, blade 250, curvilinearly extending cutting edge 252 and a top surface 254 opposite the cutting edge 252.

As can be seen from the sequence of FIG. 11, the knife 242 is initially placed flat against the lower reverse sharpening guide surface 244, which establishes a desired angular orientation of the blade 250 with respect to the abrasive surface 246. It will be understood that a user positions the knife 242 by manipulation of the handle 248.

Next, the user draws the blade 250 upwardly along the guide surface 244 while maintaining the desired angular orientation of the blade 250, and then advances the blade 250 along the abrasive surface 246 toward a distal end thereof in a manner generally discussed above. Because of the curvilinear nature of the cutting edge 252, the user may rotate the knife 242 to bring different portions of the cutting edge 252 into contact with the abrasive surface 246 while maintaining the desired angular orientation of the blade 250. In this way, the user may move the knife 242 laterally (i.e., along the length of the abrasive surface), longitudinally (i.e., retracting along the length axis of the tool) and rotationally (i.e., about a center point near the junction of the handle 248 and the blade 250).

Figure 12:
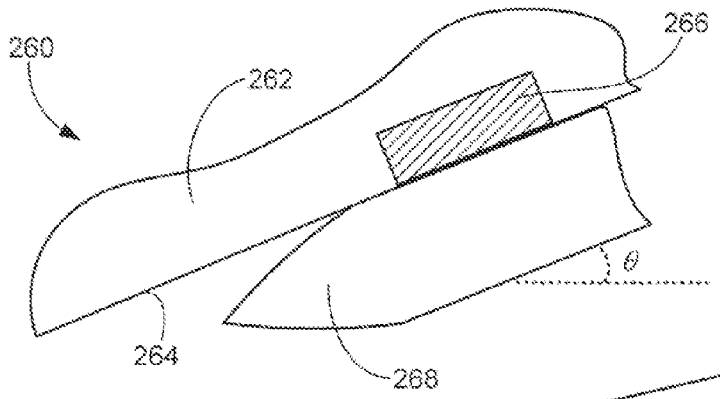
FIG. 12 shows the use of a magnet in a reverse sharpening guide to facilitate alignment of a cutting tool against the guide.

FIG. 12 is a cross-sectional depiction of another sharpening system 260 in accordance with some embodiments. The sharpening system 260 includes an upper reverse sharpening guide 262 with guide surface 264. The sharpening guide 262 includes a retention mechanism in the form of an embedded magnet 266 configured to apply a relatively low level retention bias force upon the side of a cutting tool 268 during alignment of the tool 268 against the guide surface 264. Other forms of retention mechanisms can be used as desired such as spring-biased clips, etc.

Figure 13:
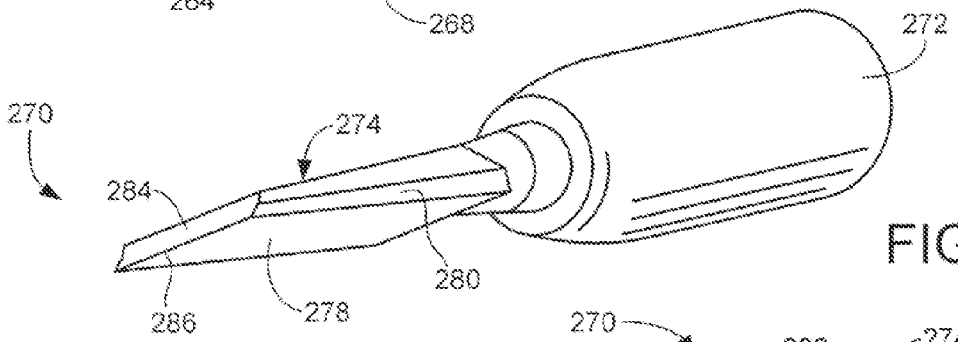
FIG. 13 is an isometric representation of a chisel type cutting tool that can be sharpened with the various sharpening systems of FIGS. 2A-12.
Figure 14:
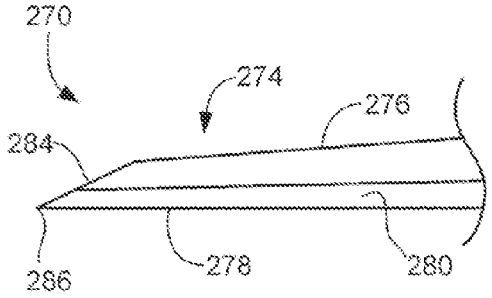
FIG. 14 is a side elevational depiction of the tool of FIG. 13.
Figure 15:
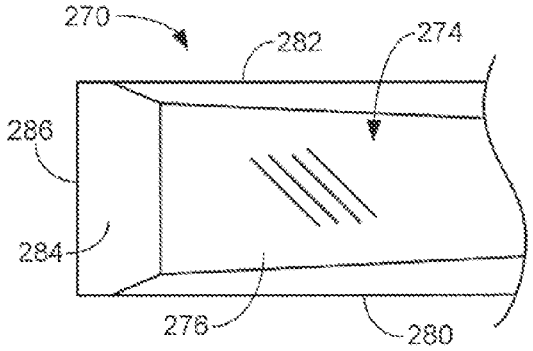
FIG. 15 is a top plan view of the tool of FIG. 13.

FIGS. 13-15 illustrate another cutting tool 270 that can be sharpened using sharpening systems as disclosed herein. The cutting tool 270 is characterized as a chisel and includes a handle 272, a blade portion 274, opposing top and bottom surfaces 276, 278, opposing side surfaces 280, 282, an end surface 284, and a cutting edge 286 formed by the intersection of the end surface 284 and the bottom surface 278. The end surface 284 may extend at an acute angle with respect to the bottom surface 278.

Figure 16:
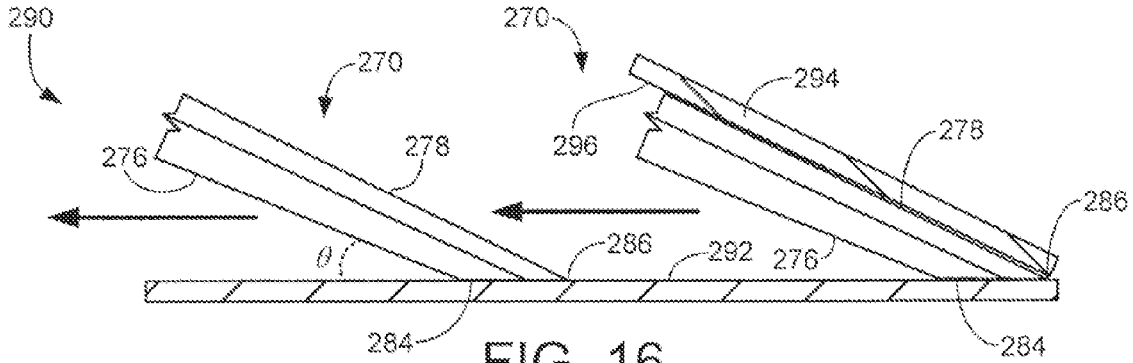
FIG. 16 depicts another sharpening system used to sharpen the tool of FIGS. 13-15.

FIG. 16 depicts a sharpening system 290 that may be used to sharpen the chisel 270 as well as other types of cutting tools. The sharpening system 290 includes an abrasive surface 292 and an adjacent upper reverse sharpening guide 294 with guide surface 296. As before, the chisel 270 can be sharpened by placing the bottom surface 278 into contacting engagement with the guide surface 296, followed by advancement of the chisel 270 along the abrasive surface 292 in a trailing cutting edge orientation. As desired, the end surface 248 of the chisel 270 can be brought into contacting engagement against a proximal end of the abrasive surface 292 during insertion against the guide surface 296.

Figure 17A:
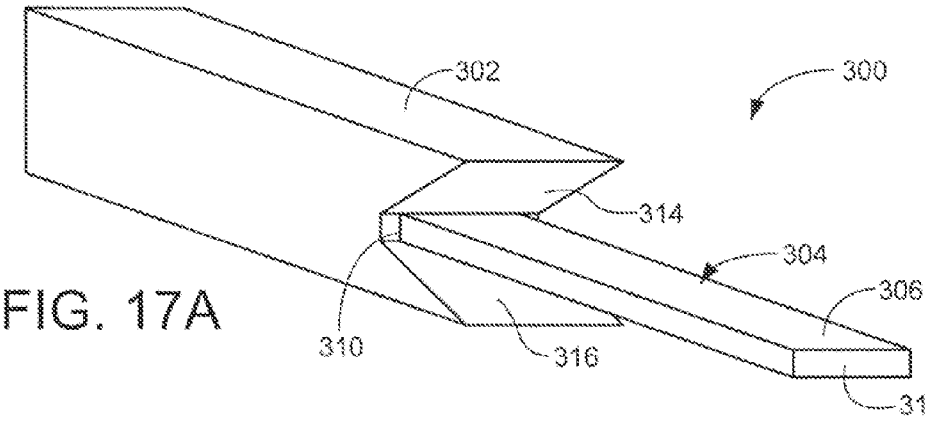
FIGS. 17A-17B are schematic depictions of another sharpening system with a pair of reversed sharpening guides in accordance with some embodiments.
Figure 17B:
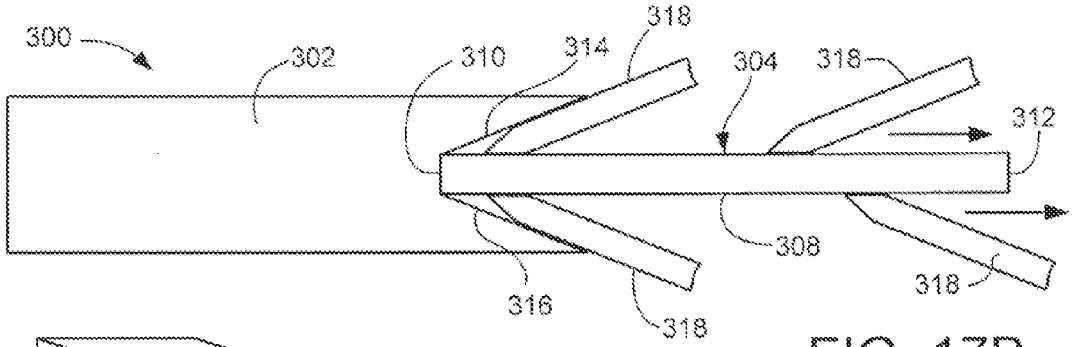

FIGS. 17A-17B illustrate yet another sharpening system 300 in accordance with some embodiments. The sharpening system 300 takes the general form of a hand held "steel" type sharpener. A main body portion 302 serves as a handle for a user to hold the sharpener 300 in a first hand. While the main body portion 302 is shown in rectilinear form, such is merely for simplicity of illustration as any number of suitable shapes, including curvilinear shapes, could be used.

An abrasive member 304 extends from the main body portion 302. The abrasive member 304 takes a generally rectilinear shape and includes opposing top and bottom abrasive surfaces 306, 308. The abrasive member 304 has a first (proximal) end 310 adjacent the main body portion 302 and an opposing second (distal) end 312.

First and second reverse sharpening guide surfaces 314, 316 extend from the main body portion 302 adjacent the proximal end 310 of the abrasive member 304. As depicted in FIG. 17B, this facilitates sharpening operations upon opposing sides of a cutting tool (e.g., double sided knife) 318.

More specifically, during a sharpening operation the user may grasp the main body portion 302 in a first hand, grasp a handle portion (not shown) of the tool 318 in a second hand, insert the tool 318 so as to be in contacting engagement against a selected one of the guide surfaces 314, 316 to set the angular orientation of the tool 318, and then advance the tool 318 along the respective abrasive surface 306, 308. Longitudinal and rotational manipulation of the tool may be carried out in a manner similar to that discussed above in FIG. 11 as the tool is advanced laterally along the length of the abrasive member in a direction toward the distal end 312.

Figure 18A:
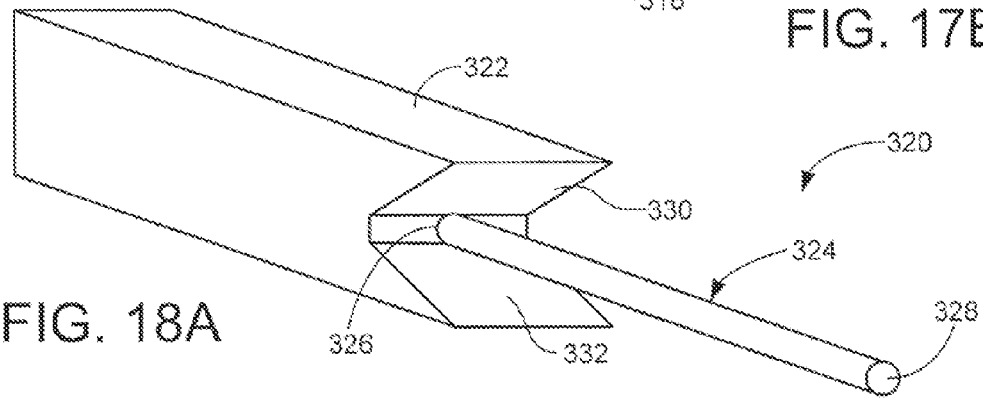
FIGS. 18A-18B are schematic depictions of another sharpening system with a pair of reversed sharpening guides in accordance with some embodiments.
Figure 18B:
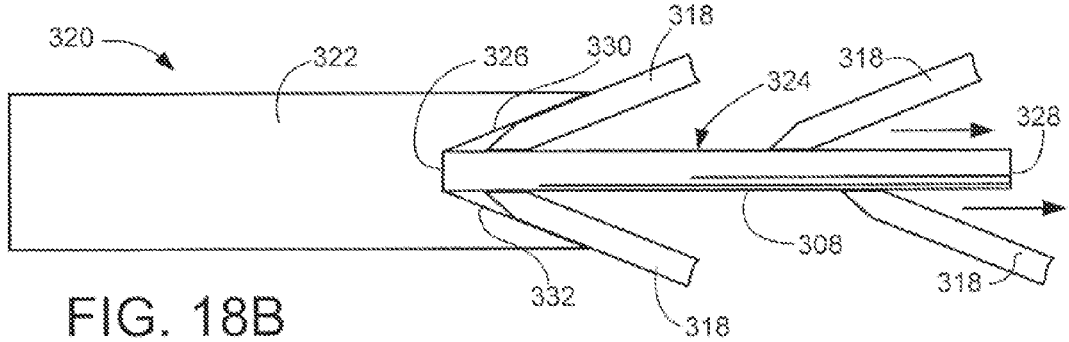

FIGS. 18A-18B illustrate another sharpening system 320 that is similar to the sharpening system 300 of FIGS. 17A-17B. As before, the sharpening system 320 is a hand held steel type sharpener with main body portion 322 and abrasive member 324. In this case, however, the abrasive member 324 is characterized as an abrasive rod with a cylindrically shaped abrasive surface. The abrasive rod may take a variety of configurations such as a steel rod, a ceramic rod, etc.

The rod has opposing proximal and distal ends 326, 328 with the proximal end 326 affixed to the main body portion 322. Reverse sharpening guide surfaces 330, 332 are disposed adjacent the proximal end 326. Sharpening of the tool 318 is carried out in similar fashion as discussed above. It will be noted that, although the abrasive rod 324 is cylindrical, the upper and lower portions thereof are aligned along respective planes and the respective guide surfaces 330, 332 form acute angles with these planes as before. It follows that while the abrasive member extends along a selected plane in a lengthwise direction, the abrasive surface itself need not necessarily be rectilinear or otherwise flat in a direction normal to this lengthwise direction (such as, e.g., FIG. 17A). Accordingly, any number of shapes and configurations of abrasive surfaces can be used.

Figure 19:
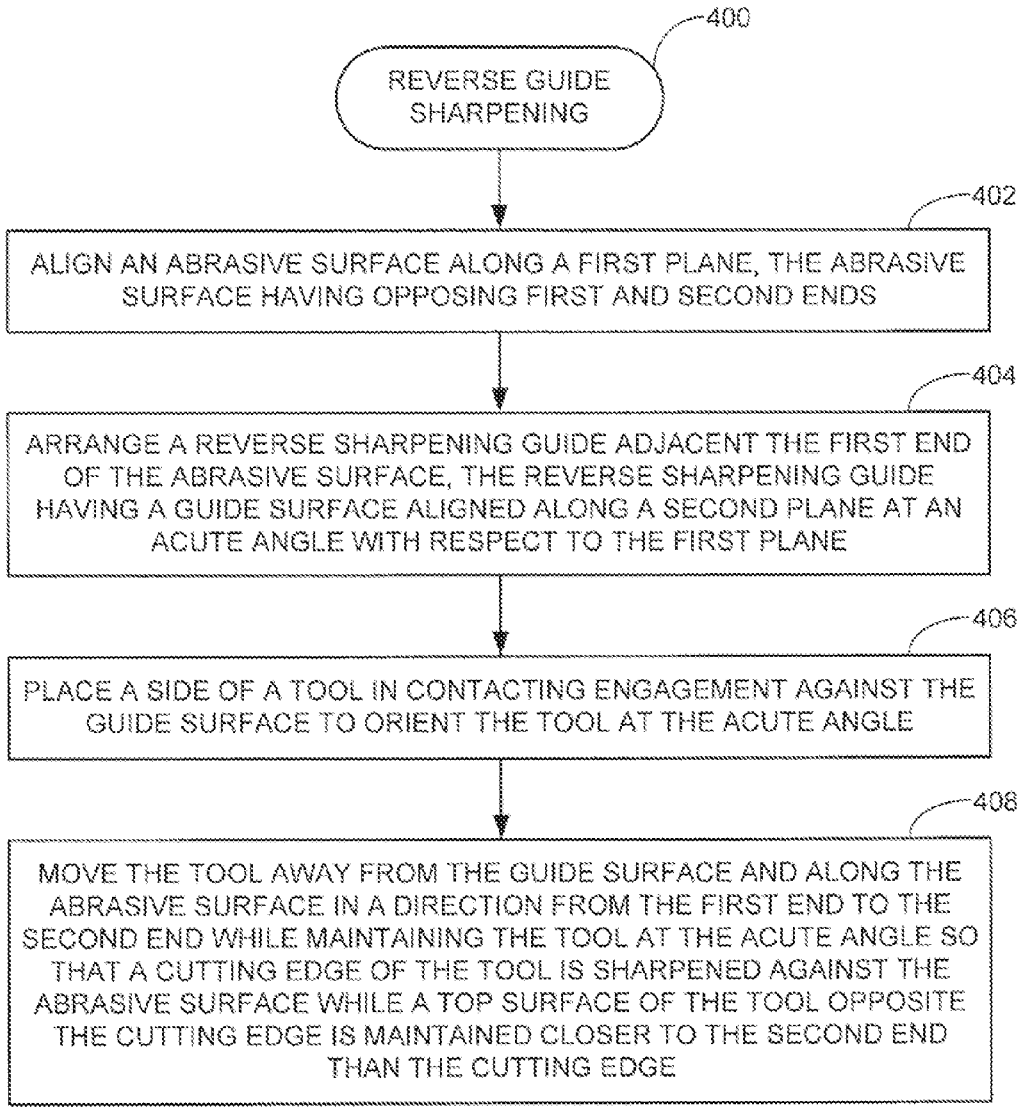
FIG. 19 is a flow chart for a routine carried out in accordance with various embodiments of the present disclosure.

FIG. 19 presents a flow chart for a REVERSE GUIDE SHARPENING routine 400 illustrative of steps carried out in accordance with the foregoing discussion. It will be appreciated that the routine 400 summarizes the sharpening operations carried out on the various embodiments discussed herein.

At step 402, an abrasive surface with opposing first and second ends is aligned along a first plane. By way of illustration and not limitation, this is discussed above including in FIG. 3A for abrasive surface 108 with opposing ends 108A, 108B and plane 110, and in FIG. 8 for abrasive surface 174 having opposing ends 174A, 174B and aligned along plane 180.

At step 404, a reverse sharpening guide is arranged adjacent the first end of the abrasive surface, with the reverse sharpening guide having a guide surface aligned along a second plane that intersects the first plane at an acute angle. This is exemplified including by but not limited to lower reverse sharpening guide 104 in FIG. 3A having guide surface 112 aligned along plane 114, and upper reverse sharpening guide 178 in FIG. 8 having guide surface 182 aligned along second plane 183.

At step 406, a side of a tool is placed in contacting engagement against the guide surface to orient the tool at the acute angle with respect to the abrasive surface. This is illustrated including in FIGS. 3A, 7, 8, 9B, 11, 16, 17B and 18B.

A sharpening operation is thereafter carried out at step 408 by moving the tool away from the guide surface and along the abrasive surface toward the second end of the abrasive member while maintaining the tool at the acute angle. This is in a trailing cutting edge orientation so that a top surface of the tool opposite the cutting edge is maintained closer to the second end of the abrasive member than the cutting edge. This is illustrated including in FIGS. 3B-3C, 4A-4B, 7, 9B, 10, 11, 16, 17B and 18B.

It will be appreciated that steps 406 and 408 can be repeated a suitable number of times in succession, such as 3-10 times. In some cases, longitudinal and/or rotational movement of the tool will be carried out by the user during step 408. In further cases, multiple sides of a tool will be sharpened, such as by reversing the orientation of the tool and using the same guide surface, or by using opposing pairs of guides.

The sharpening systems as embodied herein can be configured to provide certain advantages and benefits over sharpeners in accordance with the related art. While not necessarily required, flexible abrasives such as leather, sandpaper, rubberized media, etc. can be safely used without a likelihood of damage to the abrasive media since the cutting edge is pointed away from the direction of movement. Using locally deformable media can also support the sharpening of curvilinear concave surfaces on the sides of the tool adjacent the cutting edge (such as shown in, e.g., FIG. 12).

Using a trailing cutting edge orientation for the tool further reduces a likelihood of injury to the user during the sharpening operation. If the user slips and the tool inadvertently moves quickly away from the media as a result of the applied pressure to the tool, the cutting edge will tend to be pointing away from the direction of movement of the tool. Thus, there is a reduced likelihood that the cutting edge will injure the user or another nearby party.

As used herein, the term "acute angle" and the like will be defined consistent with the foregoing discussion as the angle between the tool and the abrasive surface with respect to the direction of movement of the tool, such as illustrated including in FIGS. 3B, 3C, 4A, 4B, 7-8, 9B, 10, 17B and 18B where the tool is pulled with the cutting edge facing away from the direction of movement. Orientations such as illustrated including in FIGS. 1, 2A-2B, 6 and 9A where the tool is pushed with the cutting edge facing toward the direction of movement are not oriented at an acute angle and instead are oriented at an "obtuse angle."

Various additional alternatives and configurations will readily occur to the skilled artisan after reviewing the present disclosure, and all such alternatives and configurations are encompassed by the present application and the following claims.

What is claimed is:

1. A method for sharpening a tool having a blade portion with opposing side surfaces, a cutting edge and a top edge opposite the cutting edge, the method comprising:

placing a selected side surface of the tool in contacting engagement against a lower reverse sharpening guide surface to orient the tool at an acute angle with respect to an abrasive surface, wherein the abrasive surface extends in a lateral direction from a first end to a second end along a first plane, the lower reverse sharpening guide surface is located proximate the first end and aligned along a second plane that intersects the first plane at the acute angle, the top edge of the tool is a first distance from the first end of the abrasive surface, and the cutting edge of the tool is a second distance from the abrasive surface greater than the first distance;

slidingly advancing the selected side surface of the tool along the reverse sharpening guide surface until the cutting edge nominally reaches the first plane of the abrasive surface; and moving the tool away from the reverse sharpening guide surface and along the abrasive surface in said lateral direction toward the second end while nominally maintaining the tool at the acute angle so that the cutting edge of the tool is sharpened against the abrasive surface in a trailing cutting edge orientation.

2. The method of claim 1, wherein the abrasive surface is characterized as a locally deformable abrasive surface so that moving the tool away from the lower reverse sharpening guide surface and along the abrasive surface locally deforms the abrasive surface responsive to pressure applied by a user to the tool, wherein remaining portions of the abrasive surface remaining aligned along said lateral direction.

3. The method of claim 1, wherein the abrasive surface and the lower reverse sharpening guide surface are each supported by a rigid body member.

4. The method of claim 1, wherein a retention mechanism applies a retention force to retain the tool against the lower reverse sharpening guide surface.

5. The method of claim 1, wherein the abrasive surface is characterized as a substantially rectangular surface with opposing first and second side surfaces respectively extending between the first and second ends, wherein the lower reverse sharpening guide surface extends along the first end from the first side surface to the second side surface.

6. The method of claim 1, wherein the abrasive surface is characterized as a cylindrical surface of an abrasive rod.

7. The method of claim 1, wherein the abrasive surface comprises a leather strop.

8. The method of claim 1, wherein the abrasive surface is characterized as an abrasive surface of a layer of flexible media, and wherein the layer of flexible media is supported on a compressible support block.

9. The method of claim 1, wherein the lower reverse sharpening guide surface is a first reverse sharpening guide surface adjacent the first end of the abrasive surface, the selected side surface of the tool is a first side surface and the remaining side surface is a second side surface, and wherein the method further comprises:

placing the second side surface of the tool in contacting engagement against a second lower reverse sharpening guide surface adjacent the second end of the abrasive surface opposite the first reverse sharpening guide surface to orient the tool at an acute angle with respect to the abrasive surface; and moving the tool away from the second reverse sharpening guide surface and along the abrasive surface in a second lateral direction opposite the lateral direction toward the first end of the abrasive surface while nominally maintaining the tool at the acute angle so that the cutting edge of the tool is sharpened against the abrasive surface in a trailing cutting edge orientation.

10. The method of claim 1, wherein the lower reverse sharpening guide surface is a first reverse sharpening guide surface, the abrasive surface is a first abrasive surface on a first side of an abrasive member, the abrasive member comprises a second abrasive surface on an opposing second side thereof, and wherein the method further comprises steps of:

placing an opposing, second side of the tool in contacting engagement against a second lower reverse sharpening guide surface adjacent the second abrasive abrasive surface to orient the tool at a second acute angle with respect to the second abrasive surface; and moving the tool away from the second reverse sharpening guide surface and along the abrasive surface in said lateral direction toward the second end of the abrasive surface while nominally maintaining the tool at the second acute angle so that the cutting edge of the tool is sharpened against the second abrasive surface in a trailing cutting edge orientation.

11. A method comprising:

providing a sharpener comprising an abrasive surface and a lower reverse sharpening guide, the abrasive surface locally deformable and having opposing first and second ends extending along a first plane, the reverse sharpening guide disposed adjacent the first end of the abrasive surface and having a guide surface extending along a second plane that intersects the first plane at an acute angle;

presenting a tool having a blade portion with a first side surface, a second side surface opposite the first side surface, a cutting edge between the first and second side surfaces, and a top edge opposite the cutting edge between the first and second side surfaces;

placing the first side surface of the tool in contacting engagement against the guide surface to orient the tool at the acute angle so that the top edge is a first distance from the first end of the abrasive surface and the cutting edge is a second distance from the first end of the abrasive surface greater than the first distance; and moving the tool away from the guide surface and along the abrasive surface in a direction parallel to the first plane and toward the second end in a trailing cutting edge orientation while nominally maintaining the tool at the acute angle.

12. The method of claim 11, wherein moving the tool away from the guide surface and along the abrasive surface comprises slidingly advancing the first side of the tool upwardly along the reverse sharpening guide surface until the cutting edge nominally reaches the first plane and then laterally advancing the cutting edge along the abrasive surface in said direction away from the guide surface and toward the second end.

13. An apparatus comprising:

a base member;

a locally deformable abrasive surface supported by the base member having opposing first and second ends, the abrasive surface extending along a first plane and facing away from the base member; and a lower reverse sharpening guide supported by the base member adjacent the first end of the abrasive surface, the lower reverse sharpening guide comprising a guide surface which extends along a second plane at an acute angle with respect to the first plane and which faces away from the abrasive surface to orient a tool at the acute angle and facilitate movement of the tool away from the guide surface and along the abrasive surface in a direction away from the guide surface and toward the second end in a trailing cutting edge orientation while nominally maintaining the tool at the acute angle.

14. The apparatus of claim 13, wherein the abrasive surface has an overall length bounded by the opposing first and second ends and an overall width bounded by opposing first and second sides, the overall width less than the overall length, and wherein the lower reverse sharpening guide is disposed between the opposing first and second sides of the abrasive surface.

15. A hand-held tool sharpener comprising a base member and an abrasive member supported by the base member, the abrasive member having an outermost abrasive surface which extends along a first plane, the abrasive surface bounded by opposing first and second ends separated by an overall length and bounded by opposing first and second side surfaces separated by an overall width less than the overall length, the base member further supporting a first lower reverse guide surface adjacent to and beyond the first end of the abrasive surface and supporting a second lower reverse guide surface adjacent to and beyond the second end of the abrasive surface so that the first and second ends of the abrasive surface are disposed between the first and second lower reverse guide surfaces, the first and second lower reverse guide surfaces extending along respective planes that intersect the first plane at a common acute angle.

16. The hand-held tool sharpener of claim 15, wherein the abrasive member is locally deformable.

17. The hand-held tool sharpener of claim 15, wherein the abrasive member is a first abrasive member and the base member further supports a second abrasive member on an opposing side of the base member having a second abrasive surface which extends along a second plane parallel to the first plane, the second abrasive surface bounded by opposing first and second ends in a length direction and bounded by opposing first and second side surfaces in a width direction, the base member further supporting a first standard guide surface adjacent to and beyond the first end of the second abrasive surface and supporting a second standard guide surface adjacent to and beyond the second end of the second abrasive surface so that the first and second ends of the second abrasive surface are disposed between the first and second standard guide surfaces, the first and second standard guide surfaces extending along respective planes that intersect the first plane at a common obtuse angle.

18. A method for sharpening a tool using the hand-held tool sharpener of claim 15, the tool having a blade portion with a first side surface, a second side surface opposite the first side surface, a cutting edge between the first and second side surfaces, and a top edge opposite the cutting edge between the first and second side surfaces, the method comprising:

placing the first side surface of the tool in contacting engagement against the first lower reverse sharpening guide surface to nominally orient the tool at the acute angle with respect to the first plane, the tool further oriented such that the top surface of the tool is a first distance from the first edge of the abrasive surface and the cutting edge of the tool is a second distance from the first edge of the abrasive surface greater than the first distance;

advancing the first side surface of the tool along the first lower reverse guide surface to nominally align the cutting edge of the tool with the first plane while nominally maintaining the tool at the acute angle;

sharpening the cutting edge of the tool by advancing the cutting edge along the abrasive surface in a direction toward the second end of the abrasive surface while nominally maintaining the tool at the acute angle.

19. The method of claim 18, further comprising subsequent steps of:

placing the second side surface of the tool in contacting engagement against the second lower reverse sharpening guide surface to nominally orient the tool at the acute angle with respect to the first plane, the tool further oriented such that the top surface of the tool is a first distance from the second edge of the abrasive surface and the cutting edge of the tool is a second distance from the second edge of the abrasive surface greater than the first distance;

advancing the second side surface of the tool along the second lower reverse guide surface to nominally align the cutting edge of the tool with the first plane while nominally maintaining the tool at the acute angle; and sharpening the cutting edge of the tool by advancing the cutting edge along the abrasive surface in a direction toward the first end of the abrasive surface while nominally maintaining the tool at the acute angle.

* * * * *